US005192167A

United States Patent [19]

da Silva et al.

[11] Patent Number: 5,192,167

[45] Date of Patent: Mar. 9, 1993

[54] SUBSEA PRODUCTION SYSTEM

[75] Inventors: José E. M. da Silva; Cezar A. S. Paulo; Amauri G. Santos Filho; Eduardo J. J. Coelho, all of Rio de Janeiro, Brazil

[73] Assignee: Petroleo Brasileiro S.A.-Petrobras, Rio de Janeiro, Brazil

[21] Appl. No.: 776,641

[22] Filed: Oct. 15, 1991

[30] Foreign Application Priority Data

Oct. 12, 1990 [BR] Brazil ..... PI 9005123

[51] Int. Cl.[5] ..... E02B 17/00

[52] U.S. Cl. ..... 405/195.1; 166/339; 166/341; 405/169; 405/170

[58] Field of Search ..... 405/195, 169, 170, 171; 166/341, 338, 339

[56] References Cited

U.S. PATENT DOCUMENTS

| | | | |
|---|---|---|---|
| 4,212,562 | 7/1980 | Stone et al. | 405/229 X |
| 4,625,804 | 12/1986 | Allen | 166/338 |
| 4,732,215 | 3/1988 | Hopper | 166/341 X |
| 4,784,527 | 11/1988 | Hunter et al. | 166/339 X |
| 5,040,607 | 8/1991 | Cordeiro et al. | 405/195.1 X |

FOREIGN PATENT DOCUMENTS

| | | | |
|---|---|---|---|
| 2195686 | 4/1988 | United Kingdom | 166/339 |

*Primary Examiner*—Dennis L. Taylor
*Attorney, Agent, or Firm*—Sughure, Mion, Zinn, Macpeak & Seas

[57] ABSTRACT

A subsea system for oil or gas production and water injection operates without divers' assistance and with guide-cables and includes a template (50) equipped with ten drilling mouths (53) arranged in two rows of five. Each drill mouth (53) has a guidepipe (54). The upper extremity of the guide-pipe presents an external section for locking purposes. A guide-base (55) is provided with four posts (56) removable by a ROV. A central space is provided in the template for the setting of a manifold (60) through four posts (63) to guide the installation and devices which ensure the final positioning of the manifold (6) within established tolerances. Bases of export-line terminals (64) are located in one of the extremities of the template (50) Each base (64) is provided with two guide-posts removable by a ROV, in addition to reaction posts (66) which orient the lowering of the pulling and connection tools and transfer the stresses to the structure of the template. Receptacles (67) lock the export-line terminals. Analogous bases are located in the other extremity of the template for the control umbilical units. Pile-guides (69) are arranged in each one of the four vertices of the structure (68) of the template. A manifold (60) including a base-structure (70) where the pipes, the hydraulic and electric control lines, the terminal (73) for connection to the WCTs (74) and to the MSTs (75) and terminals & 76, 77) for connection to the export-lines and to the hydraulic and electric umbilical units, as well as to the WCTs (74) MSTs (75) and their control system are attached.

20 Claims, 4 Drawing Sheets

SUBSEA PRODUCTION SYSTEM

BACKGROUND OF THE INVENTION

This invention refers to a subsea system for petroleum production, consisting of a structure of template-manifold, wet christmas trees and satellite tree modules, which can be equipped as well with a control system of multiplexed electro-hydraulic type, which is specifically developed to be utilized in producing areas in water depths allowing for the use of guide-cables.

FIELD OF THE INVENTION

The development of petroleum fields in deep waters having a water depth in excess of 400 m makes, for economic reasons, producing wells which are subsea. This implies that the well-head and the christmas tree be installed at the seabottom, a little above the marine soil.

For economic reasons, the usual practice has been that of grouping various wells in one single structure, which is set at the seabottom. This structure is internationally known as a template. It usually includes a structure of varied shape, often rectangular, in which there is provision for a given number of wells, which are spaced from each other according to a pattern established by the American Petroleum Institute (API). The minimum distance between well centers must be equal to 2.28 m (7.5 ft).

In the 70's the petroleum industry started adopted the production of subsea wells, and wet christmas trees were developed. In the beginning, the production of various satellite wells was collected in a central manifold, usually installed on a platform. Thereafter, the production was transported to floating units of production storage or to fixed platforms.

With the discovery of major oil fields at large water depths, the petroleum industry started adopting subsea completions as an option economically more feasible for the production development of those fields.

As a function of the specific characteristics of the producing reservoirs, the industry started developing new concepts of templates, so as to make possible the existence of various producing wells in one single area and to more easily collect of the production in one single manifold, which may or may not be incorporated into the template. Hence the expression template-manifold to identify the structures which have a manifold associated with the template.

DESCRIPTION OF THE PRIOR ART

The subsea template-manifolds which are known include structures containing guide-bases, on which are installed the well-heads and the christmas trees.

Having in view that the distance between wells meets international standards and such distance is not large, in relation to the dimensions of the equipment units to be installed, it is easy to foresee the operational and safety difficulties which must be faced so that the wells may be put in a condition to produce. The impracticability or difficulty of human diving in deep waters leads to the necessity of operations by means of a remote-operated vehicle (ROV), both for the rendering of services, such as valve operation, for instance, and for equipment inspection. Thus the subsea equipment for use in deep waters must provide spaces for passage, areas for setting, points for dockage, and interfaces in the equipment for ROV operation.

Contingency mouths are usually provided in the casing structure of wells lost during the work, which leads to larger dimensions for the structures. Should the system allow for the utilization of any lost mouth for the interconnection of a contingency well located out of the template-manifold, the structure must be more compact than those without contingency mouths.

The systems are usually provided with resident pipes, that is, linked to the structure, so that their removal for maintenance purposes is unfeasible. The use of modules with retrievable pipes is advantageous, but requires a connection system by-passing the tolerances of manufacturing and assembly or large-size structures. It is important that the flexibility for the connection be in retrievable modules, which is not usual practice.

Similarly, it is important that the elements with high possibility of failure be in retrievable modules, which can be obtained through the use of the christmas trees themselves satellite tree modules, which is not the usual practice.

Another problem which usually occurs is the setting of cuttings originating from well drilling around the heads of wells already completed, which may require expensive and difficult cleaning operations, particularly in case of deep-water operations, so that the structures must allow for the carriage of those cuttings and the accumulation of part of the cuttings without interfering with the operations.

SUMMARY OF THE INVENTION

An object of this invention is to provide a subsea production system including a subsea template structure, to be utilized in deep waters, which may offer a higher operational flexibility.

Another object of this invention is to provide a subsea production system containing a template structure which promotes larger spacing between wells, thus increasing safety in the performance of the production system operations and rendering easy, any ROV-operations.

The main object of the invention is the provision of a subsea production system including a template structure, a manifold structure, wet christmas trees, satellite tree modules, which may be equipped as well with a control of multiplexed electro-hydraulic type, and in which the active components, such as maneuver valves, chokes and control modules, are located in the christmas trees and in the satellite tree modules, instead of being in a manifold. This difference in relation to the state of art allows the maintenance to be made at the surface, since the christmas trees and satellite tree modules are retrievable. Similarly, the inclusion of those active components in the christmas trees requires only minimum modifications of the dimensions of those christmas trees in relation to the wet christmas trees of satellite wells. In addition, a higher manifold reliability is obtained.

Those objects and the advantages of the invention shall become more evident, as well as the technical solution to achieve them, in the detailed description as follows.

According to this invention, a subsea system for oil or gas production and water injection is presented, which operates without divers' assistance and with guide-cables. The system consists of a template equipped with ten drilling mouths arranged in two rows of five, each mouth consisting of a guidepipe, the upper extremity thereof presenting an external section for locking purposes and a guide-base provided with four posts removable by a ROV. A central space is provided for the setting of the manifold by means of four posts to orient the installation and devices to ensure the final positioning of the manifold within established tolerances. Bases of export line terminals are located in one of the extremities of the template. Each base is provided with two guide-posts removable by a ROV, in addition to reaction posts which guide the lowering of the pulling and connection tools and transfer the stresses to the template structure. Receptacles lock the export line terminals. Analogous bases are located in the other extremity of the template for the umbilical units of a control mechanism. Guides for piles are arranged in each of the four vertices of the template structure, consisting as well of a manifold including a base structure where the pipes are attached, the hydraulic and electric control lines, the terminals for connection to the wet christmas trees (WCTs), to the satellite tree modules (MSTs), and terminals for connection to the export lines and to the hydraulic and electric umbilical units, as well as consisting of the WCTs, MSTs and the control system.

BRIEF DESCRIPTION OF THE DRAWINGS

The invention shall be hereafter described in more detail together with the drawings which are included in this specification, in which.

DETAILED DESCRIPTION OF THE INVENTION

Figure 1:
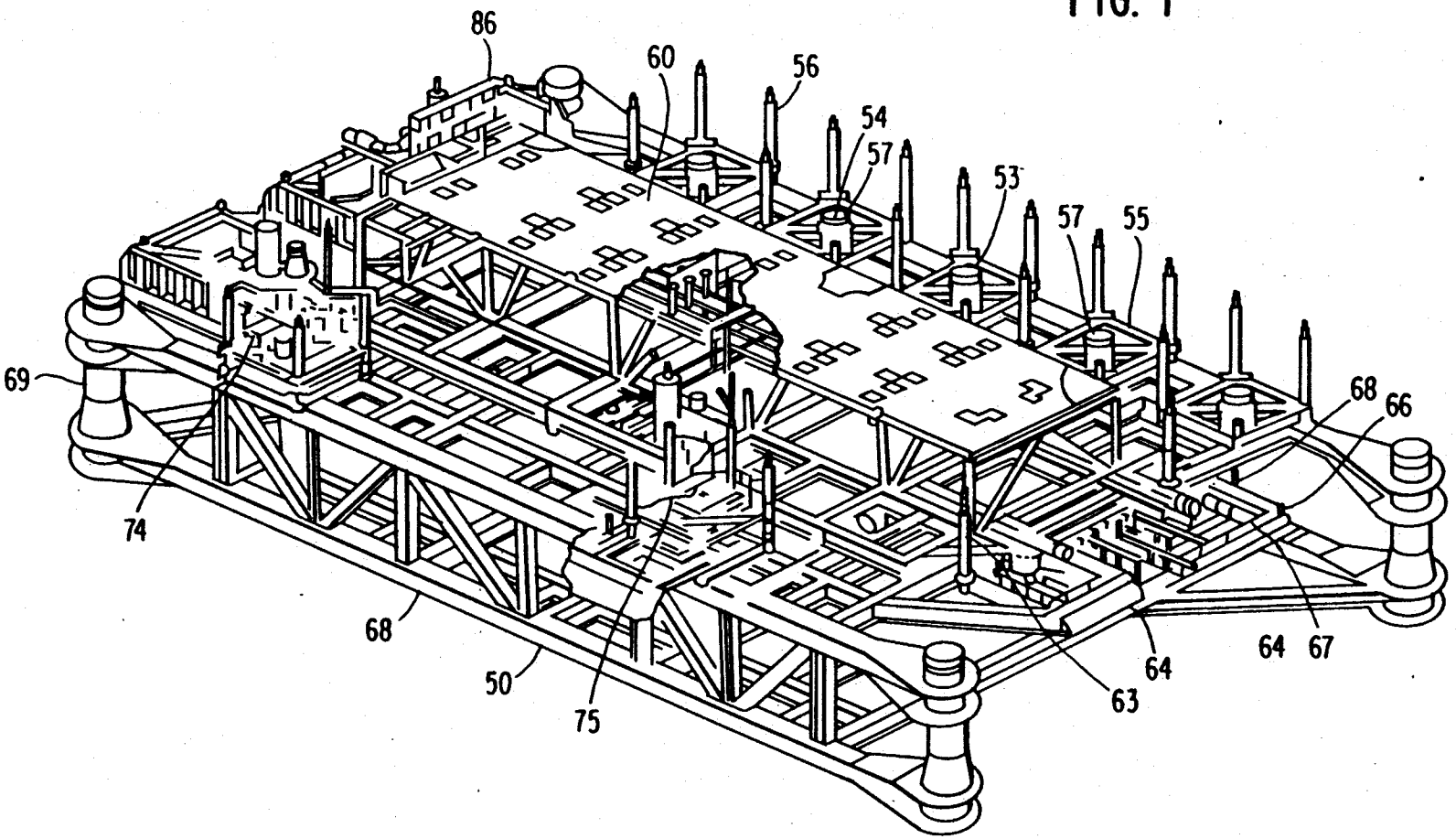
FIG. 1 is a perspective view of the subsea production system according to this invention.

As it can be inferred from the Figures, the subsea production system, according to this invention, consists of a template 50 of rectangular shape, equipped with ten drilling mouths 53 arranged in two rows of five. Each drilling mouth 53 consists of a guide-pipe 54, the upper extremity thereof presents an external section for locking purposes. A guidebase 55 is provided with four guide posts 56, removable by ROV. The distance between the wells 57 is approximately equal to 5.0 m. The guide-base 55 have, in their centers, a guide-pipe 54. The guide bases are intended to drill wells 57 and for the installation of the subsurface equipment. In this case, the head of a conductor pipe 58 (FIG. 3) is locked directly to the guide-pipe 54, without the use of gimbals, so as to reduce angular deviations of the well-head. The central space of the template 50 is prepared for the setting of the manifold 60, and is, therefor, provided with four posts 63 to guide the installation and devices to ensure the final positioning of the manifold 60 within established tolerances. In one of the extremities of the template 50 are located the two bases 64 of the export line terminals, each base 64 being provided with two guide-posts removable by a ROV, in addition to reaction posts 66, which are intended to guide the lowering of the pulling and connection tools and transfer the stresses to the template structure. The bases 64 are provided as well with receptacles 67 to lock the export line terminals, so that eventual accidental stresses, such as those caused by anchor dragging, are not transferred to the manifold 60. Those stresses are applied to the template 50, being limited through the use of mechanical fuses (breaking joints) installed in the lines. In the other extremity of the template 50 are located three bases, identical to those of the export lines, a central one intended for the connection of the electric umbilical unit, and others intended for the hydraulic umbilical units. The template 50 also presents in each one of the four vertices of the template structure or frame 68, a guide 69 for piles. Piles can be driven into the sea bed and the template 50, after being levelled, can be attached to same through elastic deformation of the pile guide walls.

Figure 2:
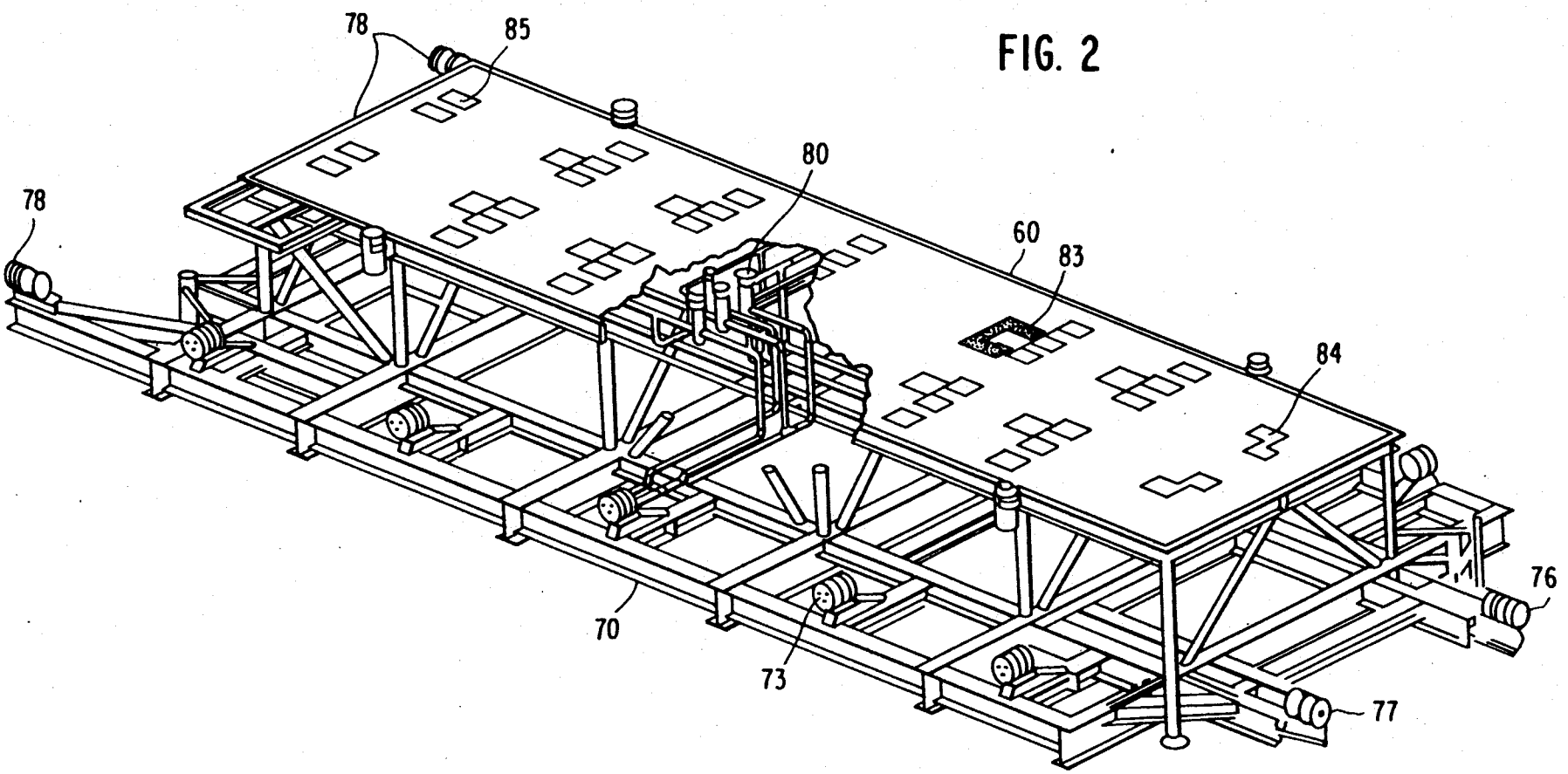
FIG. 2 is a perspective view of the manifold of the system of FIG. 1.
Figure 4:
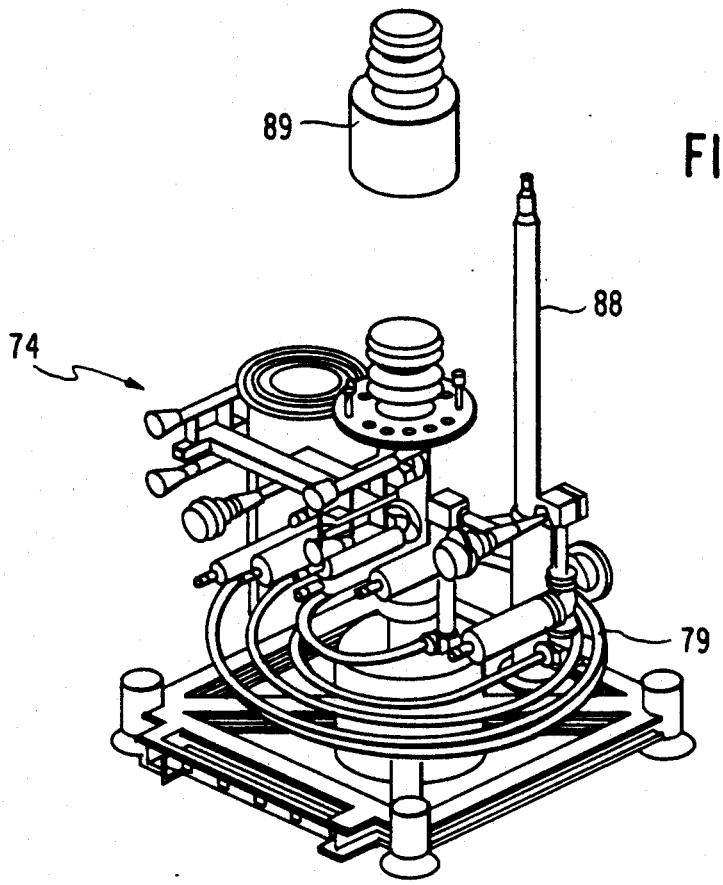
FIG. 4 is a perspective view of a wet christmas tree of the system of FIG. 1.
Figure 5:
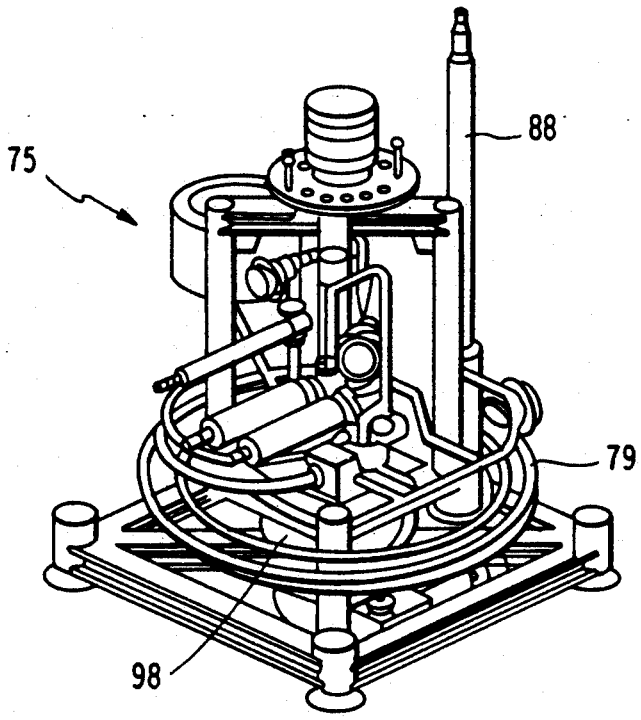
FIG. 5 is a perspective view of a satellite tree module according to this invention.

The manifold 60, according to FIGS. 1 and 2, contains a base-structure 70, to which is attached, the pipes, the hydraulic and electric control lines, the terminals 73 for connection to the WCTs 74 and to the MSTs 75, and the terminals 76, 77 for connection to the export lines and to the electric and hydraulic umbilical units 78. All pipes are rigid, in four collectors (production, production testing, gas lift and, optionally, water). In addition to their branches, the terminal 73 of each well 57 presents the lines of production, production testing, gas lift, hydraulic supply, operation of the secondary control system and subsurface safety salve (SCSSV), the terminals being rigidly attached to the base structure 70 of the manifold. The flexibility required for connection such is provided by pipe loops 79 in the WCTs 74 and MSTs 75 (FIGS. 3, 4 and 5), in one case, and by the flexibility of the export lines and umbilical units, in another case.

The manifold 60 is provided in each branch with gate-type check valves 80, preferably welded, so as to isolate any of the wells during interventions, thus allowing to maintain the manifold 60 in production, said valves 80 being operated by a ROV which, during the operation, shall remain set on a grid-type floor 83 which covers the manifold. Similarly, the collectors are provided with check valves 84 also operated by ROV and located near the connection to the export lines. Such connection is achieved through two terminals: one terminal 76 for the lines of production, gas list and production testing, and another terminal 77 for the water injection line. The valves 84 allow for the hydrostatic testing of the export lines and their connectors from the surface after the laying thereof. The collectors are interconnected by means of valves 85, so as to allow for circulation operations or, even, the temporary use of one of the lines in place of which is temporarily impeded from performing its function. To the manifold 60 arrive two hydraulic umbilical units, each one being intended to serve five wells, with eleven lines, five for the SCSSV, five for hydraulic back-up and one for supply. The supply shuttle valve can be isolated and replaced by a ROV, in case of failure, the supply being maintained from one of the umbilical units.

The electric umbilical unit is connected to the manifold by means of an electric distribution module 86 (EDM), FIG. 1, it being through this module that the two cables (power and signal) branch out into ten pairs of cables. The EDM 86, in spite of being installed together with the manifold 60, can be retrieved independently, its connection to the umbilical unit is achieved by means of a terminal identical to that of the flow lines. The connection to the manifold is achieved through ROV-operated connectors. The system of this invention allows, with only minor modifications, for the installation of the manifold 60 together with the template, so as to put the wells in production as they are drilled.

Figure 3:
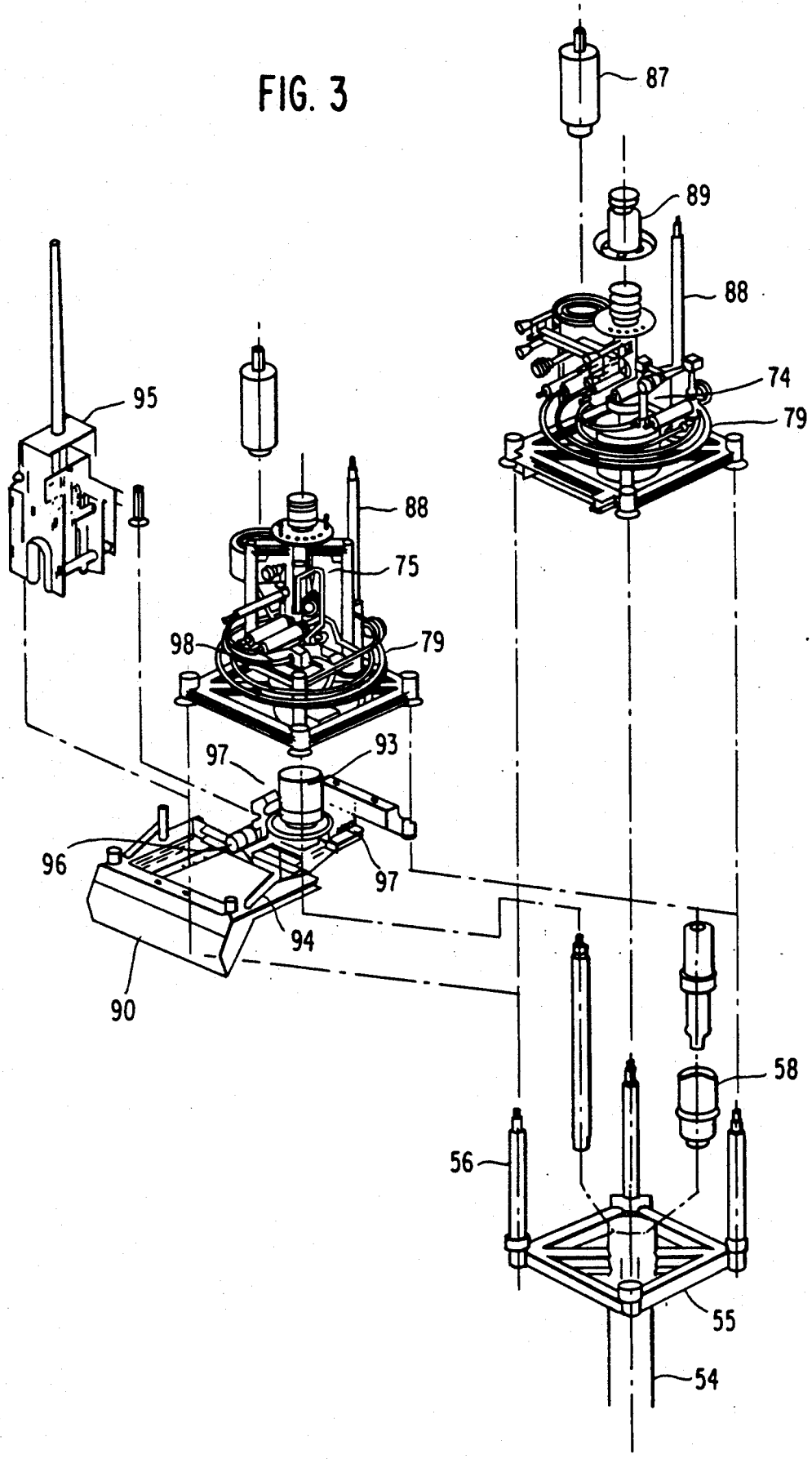
FIG. 3 is an exploded view of the well equipment for one well of the system of FIG. 1.

This concept removes from the manifold active components, such as maneuver valves, chokes, control modules 87, FIG. 3, and transducers, incorporating them to the arrangement of the WCT 74, and allowing, on the one hand, that, they be within a retrievable module, and maintenance be carried out at the surface. On the other hand, for higher manifold reliability, the inclusion of these components imply minimum modifications in the dimensions of the WCT 74 in relation to the WCTs of satellite wells. As a function of the maneuver valves being incorporated to the WCT, its connector to the manifold presents three flow lines: a production line a production testing line and an annulus, in addition to the hydraulic lines. Flexibility for connection to the manifold is obtained through loops located in those lines of the WCT. The valves of the WCT have operating devices turned to the external face of the template-manifold and equipped with an interface for secondary operation by a ROV. Similarly, the chokes have their position indicators turned to the outside of the template-manifold, allowing for an easy visualization.

The WCT 74 is equipped with an anchoring system for ROV-operation, not only of the block and line valves, but also of small-diameter valves. The WCT 74 is equipped with a reentry post 88, FIG. 3, which allows, through one single guide-cable connected by ROV, installation or retrieval of the control module 78, the tree cap 89 of the WCT, as well as the connection of an installation tool for the performance of wireline operations. Another characteristics of this WCT is the availing itself of a system of secondary unlocking of the well-head connector, by means of a tool similarly oriented by the reentry post 88. The production WCT may be converted to a water injection WCT, on board the completion rig, through the mere inversion of the production choke.

The subsea production system was conceived so as to allow for the interconnection of satellite wells; therefor, any of the ten guide-bases 55 may be utilized, even in the presence of an installed well-head. This flexibility is obtained through the installation of an intermediate, flow-line structure 90, FIG. 3, locked externally to the guide-pipe 54. The flow-line structure 90 consists of a mechanical connector 93 operated by a specific tool to be locked to the external section of the guide-pipe 54 of the template 50 and with on internal section in its upper portion to lock the MST 75. Branching out from the connector are beams on which is welded a cradle-structure 94 identical to those utilized in the template for the connection of the export lines and umbilical units, except for the absence of guide-posts since in this case the pulling tool and that of connection 95 are oriented by the external guide posts 56 of the guide-base. Similarly, the lines originating from the satellite wells are be equipped with terminals similar to those of the export lines and umbilical units.

The cradle-structure 94 facilitate the setting of the pull-in tool, which pulls and locks the lines of the satellite well. The connection tool 95 is then lowered, which releases the terminal from the lines and then move it towards the terminal 96 of the intermediate flow-line structure 90, inserting among them a plate containing the sealing rings. Finally, two clamps are fastened against the terminals by means of bolts operated by the connection tool 95. From the terminal 96 of the flow-line structure branch out annulus and production pipes, as well as eight hydraulic lines and an electric cable for a pressure and temperature transducer (DPTT), ending in two vertical connectors 97, one for the flow lines and another for control, the flow-line structure 90 being installed with drill pipe through the moonpool of the completion rig.

The MST 75 allows for flow control between the satellite well and the manifold, and also transmits the functions of control and supervision. The MST 75 includes a connector 98 which is locked internally to the mechanical connector 93 of the flow-line structure 90. This connector 93 is hydraulically operated and provided with a secondary mechanical unlocking mechanism, with extension up to the top of the MST 75 for operation by a tool run with drill pipe, incorporating the maneuver valves, chokes, control modules and transducers. The MST 75 presents two vertical connectors for connection to the connectors 97 of the flow-line structure 90. The terminal of the MST 75 for horizontal connection to the manifold is identical to that of the WCT. The valves of the MST have their operating devices turned to the external face of the template-manifold and equipped with an interface for secondary operation by ROV. Similarly, the chokes present their position indicators to the outside of the template-manifold.

The MST is provided also with an anchoring system for ROV-operation of maneuver valves and small-diameter valves, being equipped with a reentry post 88 with functions identical to that of the WCT. The MST 75 can be similarly converted from production to water injection through the mere inversion of the production choke.

The template-manifold may be equipped with a control system of multiplexed electro-hydraulic type, with control modules 87 located in the WCTs 74 and MSTs 75.

We claim:

1. A subsea production system comprising: a template structure, a manifold structure, means for mounting said manifold structure to said template structure, a plurality of wet christmas tree modules, a plurality of satellite tree modules, said manifold structure containing pipes, control lines, check valves for said pipes and connectors, said template structure comprising means for detachably mounting said plurality of wet christmas tree modules and said plurality of satellite tree modules adjacent said manifold and about the perimeter of said template structure, and wherein said wet christmas tree modules and said satellite tree modules comprise at least one maneuver valve, choke, control module and transducer constituting active components of the subsea production system such that the subsea production system may be utilized in deep waters, offer a high operational flexibility while allowing the active components of the system within the detachably mounted christmas tree and satellite tree modules to be serviced at the surface of the sea after removal from the subsea production system template structure.

2. Subsea production system according to claim 1, wherein said templated structure comprises a plurality of guide bases spaced about the periphery of the template structure, drilling mouths respectively at each guide-base, each mouth consisting of a guide-pipe, each guide-base being provided with four posts removable by a ROV; said template structure includes a central place internally of said guide bases and is provided with posts for setting of said manifold structure; and said template structure further comprising based for export-line terminals located in one extremity of said template structure; additional bases identical to the bases for said export-line terminals located in another extremity of said template structure, and wherein said template structure has four vertices and a pile guide positioned at each of said four vertices.

3. Subsea production system according to claim 1, wherein said manifold structure comprises: a manifold base structure for attachment of said pipes and multiplexed electro-hydraulic control lines having mounted thereto terminals for connection to said wet christmas tree modules and to said satellite tree modules, terminals for connection to the export-lines and to electric and hydraulic umbilical units, wherein said manifold structure further includes gate-type check valves; collectors located near connections to said export-lines, and valves interconnecting the collectors; said system further comprising within said manifold structure, oil well production testing pipes, water injection pipes and gas lift pipes, and connectors mounted to said manifold structure for connection of said pipes to said plurality of wet christmas tree modules and said plurality of satellite tree modules, said export-lines and said control umbilical units.

4. Subsea production system according to claim 2, wherein each base of said export-line terminals is provided with two ROV removable guide posts, and wherein said template structure further comprises reaction posts for guiding the pulling and connection tools during lowering of said tools and transferring stresses on said tools to the template structure.

5. Subsea production system according to claim 2, wherein said base of said export-line terminals further comprises receptacles to lock the export-line terminals to said template structure.

6. Subsea production system according to claim 2, wherein one of said additional bases comprises a central base for connection of the electrical umbilical unit to said template structure and two other additional bases comprise connection means for connection to said hydraulic umbilical units.

7. Subsea production system according to claim 3, wherein said manifold base structure comprises a plurality of well terminals and receiving ends of said production testing pipes, gas lift pipes, hydraulic supply pipes carried by said manifold structure and further comprise components of a secondary system and a subsurface safety valve.

8. Subsea production system according to claim 3, wherein said well terminals are rigidly attached to said manifold base structure, and wherein loops within said wet christmas modules and said satellites tree modules provide flexibility to the connections effected by said well terminals and said export-lines and said umbilical units comprise flexible units.

9. Subsea production system according to claim 3, wherein said valves of said plurality of wet christmas tree modules have operating devices turned to an external face of the template structure and are equipped with an interface for secondary operation by a ROV.

10. Subsea production system according to claim 3, wherein said wet christmas tree modules contain a reentry post to install or retrieve a control module, a tree cap of the wet christmas tree module and to connect said installation tool for performing wireline operations.

11. Subsea production system according to claim 10, further comprising means for inverting a production choke to convert a wet christmas tree production module to a water injection wet christmas tree module.

12. Subsea production system according to claim 2, wherein said guide-pipes are provided with external sections to lock one of a guide-funnel and an intermediate flow-line structure.

13. Subsea production system according to claim 12, further comprising an intermediate flow-line structure locked externally to said guide-pipe.

14. Subsea production system according to claim 12, wherein said intermediate flow-line structure comprises a mechanical connector, a cradle structure, guides branching out of said mechanical connector and said cradle structure and a terminal welded to said branched out guides.

15. Subsea production system according to claim 14, wherein said terminal for connection to annulus, production and hydraulic pipes and electric cable for a pressure and temperature transducer of one of a wet christmas module and a satellite tree module, terminating in two vertical connectors.

16. Subsea production system according to claim 3, wherein said satellite tree module includes a connector for locking internally to said mechanical connector of said intermediate flow-line structure, said connector being hydraulically operated and provided with secondary mechanical unlocking means for selective extension to the top of said satellite tree module.

17. Subsea production system according to claim 16, wherein said satellite tree module valves include operating devices turned to an external face of said template structure and are equipped with an interface for secondary ROV operation.

18. Subsea production system according to claim 1, wherein said satellite tree module includes a reentry post identical to the reentry post of said wet christmas tree module.

19. Subsea production system according to claim 18, wherein said production satellite tree module includes means for inversion of a production choke for conversion of said module to a water injection satellite tree module.

20. Subsea production system according to claim 2, wherein said intermediate flow-line structure and said satellite tree module are installable in any well mouth at anyone of the template structure bases about the periphery of the template structure so as to interconnect a plurality of satellite wells, whereby said system operates as a manifold for all mouths and an intermediate flow-line structure mounted thereto.

* * * * *